US007121270B1

(12) United States Patent
Plotnikov

(10) Patent No.: US 7,121,270 B1
(45) Date of Patent: Oct. 17, 2006

(54) SPARK GENERATION METHOD AND IGNITION SYSTEM USING SAME

(75) Inventor: Alexander Plotnikov, Ottawa (CA)

(73) Assignee: VimX Technologies Inc., Kanata (CA)

( * ) Notice: Subject to any disclaimer, the term of this patent is extended or adjusted under 35 U.S.C. 154(b) by 0 days.

(21) Appl. No.: 11/212,580

(22) Filed: Aug. 29, 2005

(51) Int. Cl.
*F02P 3/04* (2006.01)
*F02P 3/08* (2006.01)

(52) U.S. Cl. ..... 123/604; 123/620; 123/640

(58) Field of Classification Search ..... 123/598, 123/604, 605, 620, 640
See application file for complete search history.

(56) References Cited

U.S. PATENT DOCUMENTS 3,280,809 A * 10/1966 Issler ..... 123/598
3,943,905 A * 3/1976 Hartig ..... 123/604
3,972,315 A * 8/1976 Munden et al. ..... 123/604
4,892,080 A * 1/1990 Morino et al. ..... 123/604
6,085,733 A 7/2000 Motoyama et al.
6,123,063 A * 9/2000 Boerjes ..... 123/620
6,397,827 B1 6/2002 Kato et al.
6,694,959 B1 2/2004 Miwa et al.
6,729,317 B1 5/2004 Kraus

* cited by examiner

*Primary Examiner*—T. M. Argenbright
(74) *Attorney, Agent, or Firm*—Freedman & Associates

(57) ABSTRACT

An ignition system providing power and duration controlled ignition spark, comprises a spark controller, first switching energy accumulator, storage capacitor, and second switching energy accumulator with an ignition coil. The ignition system utilizes dual means of switching energy accumulation, internal energy transfer, and three means of energy release to the ignition spark, working in all possible combinations managed by means of the spark controller depending on engine operating conditions, and provides continuous bipolar ignition spark. Spark profile is regulated by means of control signals (2) and (3) based on their frequency, duty cycle, interrelation, and running time.

38 Claims, 5 Drawing Sheets

SPARK GENERATION METHOD AND IGNITION SYSTEM USING SAME

FIELD OF THE INVENTION

The invention relates generally to internal combustion engines, and more particularly to spark generation for an internal combustion engine.

BACKGROUND ART

Internal combustion engines are well known. In operational cycle of the engine, fuel and air are drawn into a chamber by movement of a piston away from an inlet of the chamber, the fuel is then compressed by movement of the piston in an opposite direction—toward the inlet, a spark ignites the fuel forcing the piston away from the inlet and then the chamber is partially evacuated by the final piston movement toward an exhaust thereof near the inlet end. Though according to a simplified ideal theory a single spark will consume all of the fuel within the chamber in a near instantaneous fashion, this is not the case in reality.

Two prior art ignition systems that are very widely used are inductive discharge systems and capacitive discharge systems. The difference between the two systems relates mostly to an energy storage component used within each circuit where the inductive discharge system relies on an inductor and the capacitive discharge system relies on a capacitor. When using an inductive discharge based system energy tends to fall off at high revolutions per minute (related to strokes/minute) because an insufficient dwell time, to charge the coil, is provided. Further, a resulting low secondary voltage rise makes sensitivity to spark gap fouling significant. Typically, energy delivered to the spark plug gap is in range of 20–50 mJ at 1–2 ms of spark and has decaying power across its duration.

Capacitive discharge systems are known to release more spark energy over a relatively short period of time. Capacitive discharge systems produce up to 100 mJ of spark energy, but are characterized by limited spark duration of 150–500 μs. This very short spark duration results in significant difficulty igniting fuel during cold start conditions, with lean mixtures, and during transient behaviour of carburetion. Unfortunately, each of these systems provides only a single short duration spark, and as such, may fail to ignite all or a portion of the fuel within the chamber.

Multi-spark ignition systems represent an alternative to traditional inductive discharge and capacitive discharge systems. In a multi-spark ignition system, sparking occurs repetitively over a period of time. This has been shown to better influence combustion initiation—more reliably ignite the fuel within the chamber. When used on cold engines, multi-spark ignition systems typically more reliably start the engine. In multi-spark ignition systems, an energy discharge and charge cycle is created to charge and discharge a spark generation circuit to produce sparks at intervals and having similar profiles. Another approach to multi-spark is to discharge the spark generation circuit in a fashion resulting in an oscillation that oscillates below and above a sparking threshold resulting in periodic sparking during discharge.

Many multi-spark ignition systems rely on inductive discharge and as such provide lower energy discharge for a longer duration as disclosed, for example, in U.S. Pat. No. 6,397,827, wherein a high voltage is intermittently applied from an ignition coil for more than one time in a short time to generate sparks.

Multi-spark systems including those disclosed in U.S. Pat. No. 6,694,959 and U.S. Pat. No. 6,085,733 and high-frequency ignition systems as disclosed in U.S. Pat. No. 6,729,317 provide for increased overall sparking time during a stroke. The multi-spark ignition systems are able to maintain spark discharge above a desired energy level for a longer proportion of the stroke, in an interrupted and unipolar fashion. The high-frequency ignition systems are complex and produce a sinusoidal output voltage that reduces the formation of efficient plasma in the spark gap.

It would be advantageous to provide a spark discharge ignition system that overcomes the drawbacks of the prior art.

SUMMARY OF THE INVENTION

Accordingly, it is an object of the present invention to provide an ignition system for internal combustion engines, which is simple and flexible.

According to the invention there is provided an ignition system for providing energy across a spark gap comprising: a first series closed circuit including a DC power supply, a primary winding of an energy storage coil and a first switching device; the first circuit for supporting a charge of the energy storage coil when the first switching device is conducting, and a discharge of energy stored within the energy storage coil when the first switching device is nonconducting; a second series closed circuit including a secondary winding of the energy storage coil, a first diode and an energy storage capacitor, the diode for preventing a flow of current from the energy storage capacitor to the secondary winding of the energy storage coil; a third series closed circuit including the secondary winding of the energy storage coil, the first diode, a primary winding of an ignition coil and a second switching device; the second and the third series closed circuits for supporting the discharge of energy stored within the energy storage coil via the first diode to the energy storage capacitor when the second switching device is nonconducting, and to the ignition coil when the second switching device is conducting; a fourth series closed circuit including the energy storage capacitor, the primary winding of the ignition coil and the second switching device; the fourth circuit for supporting the discharge of energy stored within the energy storage capacitor to the ignition coil when the second switching device is conducting; a fifth series closed circuit including the DC power supply, a second diode, the primary winding of the ignition coil and the second switching device, the diode for providing a flow of current from the DC power supply to the primary winding of the ignition coil when the energy storage coil and the energy storage capacitor are discharged; the fifth circuit for supporting a charge of the ignition coil when the second switching device is conducting, and a discharge of energy stored within the ignition coil when the second switching device is nonconducting; and, a control circuit for generating a first control signal and a second control signal, the first control signal for operating the first switching device, and the second control signal for operating the second switching device, wherein the components within the ignition system are chosen to support generation of a continuous spark across the spark gap.

Additionally, the invention supports an ignition system for providing energy across a spark gap comprising: a first series closed circuit including a DC power supply, a primary winding of an energy storage coil and a first switching device; the first circuit for supporting a charge of the energy storage coil when the first switching device is conducting, and a discharge of energy stored within the energy storage coil when the first switching device is nonconducting; a second series closed circuit including a secondary winding of the energy storage coil, a first diode and an energy storage capacitor, the diode for preventing a flow of current from the energy storage capacitor to the secondary winding of the energy storage coil; a third series closed circuit including the DC power supply, a primary winding of an ignition coil, the secondary winding of the energy storage coil, the first diode and a second switching device; the second and the third series closed circuits for supporting the discharge of energy stored within the energy storage coil via the first diode to the energy storage capacitor when the second switching device is nonconducting, and to of the ignition coil when the second switching device is conducting; a fourth series closed circuit including the DC power supply, the primary winding of the ignition coil, the energy storage capacitor and the second switching device; the fourth circuit for supporting the discharge of energy stored within the energy storage capacitor to the ignition coil when the second switching device is conducting; a fifth series closed circuit including the DC power supply, the primary winding of the ignition coil, a second diode and the second switching device, the diode for providing a flow of current from the primary winding of the ignition coil to the second switching device when the energy storage coil and the energy storage capacitor are discharged; the fifth circuit for supporting a charge of the ignition coil when the second switching device is conducting, and a discharge of energy stored within the ignition coil when the second switching device is nonconducting; a control circuit for generating a first control signal and a second control signal, the first control signal for operating the first switching device, and, the second control signal for operating the second switching device, wherein the components within the ignition system are chosen to support generation of a continuous spark across the spark gap.

According to another aspect of the invention there is provided a method of ignition spark generation comprising: providing an energy storage coil; providing an energy storage capacitor; providing an ignition coil; storing energy within the energy storage coil; storing energy within the energy storage capacitor; storing energy within the ignition coil; switching the energy stored within each of the energy storage coil and the energy storage capacitor to the ignition coil for generating a spark across a spark gap; switching the energy stored within the energy storage coil to the ignition coil for generating the spark across the spark gap; switching the energy stored within the energy storage capacitor to the ignition coil for generating the spark across the spark gap; and switching the energy stored within the ignition coil for generating the spark across the spark gap.

According to another aspect of the invention there is provided a method of cleaning a combustion chamber of an engine comprising: providing a first spark profile within the combustion chamber and during combustion, the first spark profile for cleaning the combustion chamber and, when the combustion chamber is sufficiently clean, providing a second other spark profile within the combustion chamber for effecting operation of the combustion within known limits.

According to another aspect of the invention there is provided a method of cleaning a combustion chamber of an engine comprising: providing an ignition system having a first spark profile; determining a second other spark profile for provision within the combustion chamber and during combustion, the second other spark profile for cleaning the combustion chamber and, providing the second other spark profile within the combustion chamber.

According to another aspect of the invention there is provided a method of cleaning a combustion chamber of an engine comprising: providing fuel to the engine; in dependence upon the fuel type and mixture providing a first spark profile, determined for the type and mixture of the fuel within the combustion chamber; providing a second other fuel to the engine; and in dependence upon type of the second other fuel providing a second other spark profile, determined for the type and mixture of the other fuel within the combustion chamber.

BRIEF DESCRIPTION OF THE DRAWINGS

Embodiments of the invention will now be described with reference to the attached drawings in which similar reference numerals designate similar items.

DETAILED DESCRIPTION OF THE PREFERRED EMBODIMENTS

In the description hereinbelow, the term ON is used with relation to a switch when the switch is conducting current and OFF is used when the switch is other than conducting.

The terms continuous discharge and continuous spark discharge are used herein to refer to a continuous spark across the spark gap during the duration of combustion, for example the combustion stroke of an engine. A continuous spark discharge will span a plurality and often many energy storage and release cycles for a charge storage device within an ignition circuit.

Figure 1:
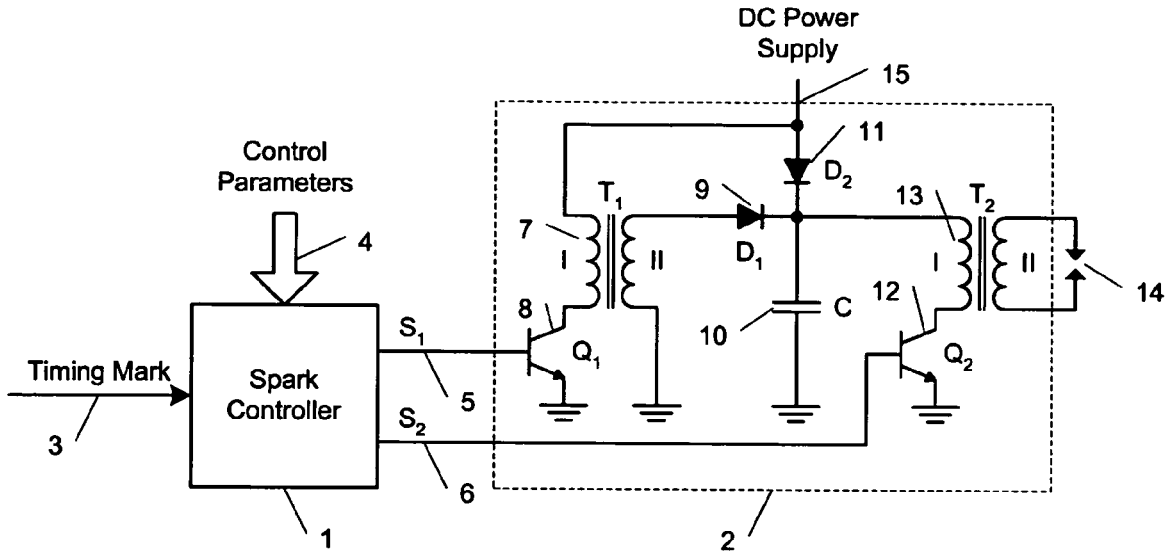
FIG. 1 is a schematic block diagram of a circuit according to an embodiment of the invention having two energy storage devices, an ignition coil, and two switches for independently being controlled.

Referring to FIG. 1, shown is a circuit diagram of an ignition system in accordance with an embodiment of the present invention. The ignition system includes spark controller 1 which provides a first control signal along conductor 5 and a second control signal along conductor 6. Along conductor 5, the first control signal is provided for controlling storage coil switch 8 and along conductor 6 the second control signal is provided for controlling ignition coil switch 12. A timing mark 3 is provided to the spark controller 1 for use in timing of spark control and control parameters 4 are provided for use in controlling spark parameters in the form of spark duration and spark profile.

Also within the circuit diagram shown is a spark generation circuit 2 composed of three functional groups. A first functional group comprises a series closed circuit comprising a DC power supply 15, a primary winding of storage coil 7 and switch 8 in the form of a transistor. A second functional group comprises a series closed circuit comprising a secondary winding of storage coil 7, blocking diode 9 and storage capacitor 10. A third functional group comprises a series closed circuit comprising the DC power supply, blocking diode 11, a primary winding of ignition coil 13 and switch 12 in the form of a transistor.

An operation of the storage coil 7 is controlled by the first control signal $S_1$ along conductor 5. Energy is accumulated in the storage coil 7 when the switch 8 is ON and is released through the blocking diode 9 when the switch 8 is OFF. The ON time of the switch 8 defines the amount of energy stored in the storage coil 7. The OFF time of the switch 8 defines the amount of energy of the storage coil 7 released through the blocking diode 9.

The storage capacitor 10 fully or partially accumulates energy transferred from the storage coil 7 when the switch 8 is OFF.

An operation of the ignition coil 13 is controlled by the second control signal $S_2$ along conductor 6. When the switch 12 is ON, energy transferred from the storage capacitor 10, from the storage coil 7, or from DC power supply 15 is fully or partially accumulated in the ignition coil 13 and is fully or partially released through a secondary winding of the ignition coil 13 depending on a breakdown condition of spark plug gap 14. When the switch 12 is OFF, the energy accumulated in the ignition coil 13 is released through the secondary winding of the ignition coil 13 to the spark plug gap 14.

There are several control methodologies for the energy transfer that are achievable in dependence upon different first and second control signals. For example, a simple ignition system allows for simple inductive discharge operation. Here, the second control signal operates with the capacitor 10 discharged, and the diode 11 conducting. When the switch 12 is set to the ON position, the ignition coil 13 begins charging from the power supply 15 through the diode 11. When the switch 12 is switched to an OFF position, electrical discharge occurs in the spark plug gap 14 with a first polarity, for example a positive polarity. This results in a spark profile similar to that commonly achieved with known inductive discharge ignition systems having a dwell time while the switch 12 is ON.

Different behaviour is observed when the capacitor 10 is charged to a significantly higher voltage than the voltage of the DC power supply 15. When the switch 12 is switched to the ON position, the rising current in the primary winding of the ignition coil 13 generates high voltage in the secondary winding proportional to the charge voltage of the capacitor 10 and causes breakdown of the spark plug gap 14 with, for example, negative polarity until the voltage of the capacitor 10 drops to the voltage of the DC power supply 15. This in isolation is known as a capacitive discharge ignition. When the voltage of the capacitor 10 is less than the voltage of the power supply 15, the diode 11 conducts and additional rising current from the power supply 15 flows through the primary winding of the ignition coil 13. When the switch 12 is switched to the OFF position, the electrical discharge in the spark plug gap 14 changes a polarity of the discharge current.

The use of the storage coil in the form of a transformer allows for electrical isolation and slower energy release to the ignition coil but supports a same rate of energy accumulation, or current rise, in its primary coil. This is highly advantageous in some applications. Of course the slower release results in a longer discharge time having a lower discharge peak energy.

Figure 2:
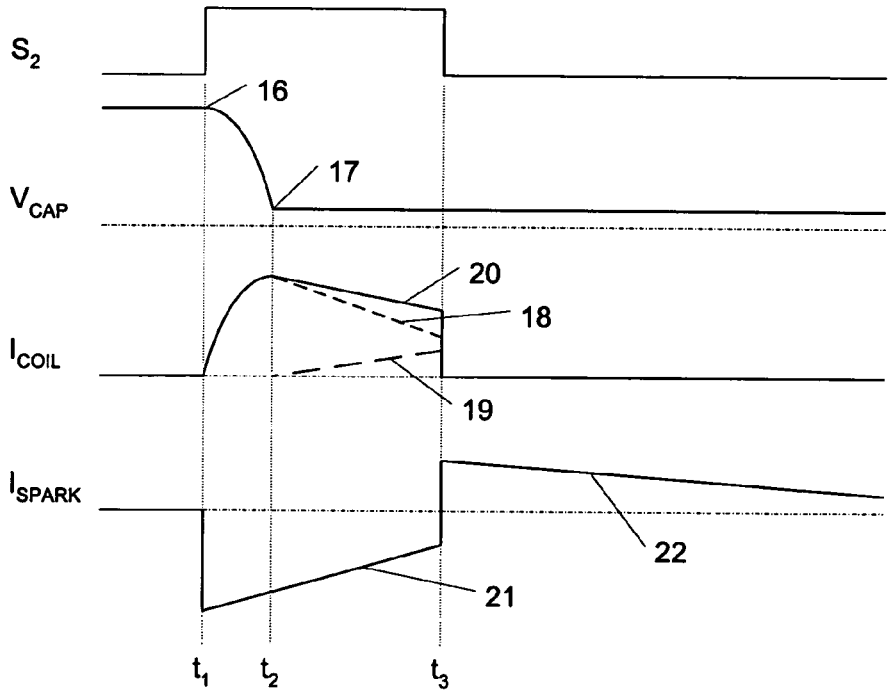
FIG. 2 is a timing diagram showing signals generated during operation of the circuit of FIG. 1 for bipolar electrical discharge.

Referring to FIG. 2, shown is a simplified timing diagram of signals within the circuit of FIG. 1 during bipolar spark discharge. At $t_1$, when the ignition coil switch 12 is ON, relating to the second control signal $S_2$, the voltage of the storage capacitor (10 in FIG. 1) $V_{CAP}$ has an initial value 16, and the spark discharge of negative polarity occurs in its capacitive discharge phase 21. At $t_2$ the storage capacitor has discharged to its lower value 17 and the second diode (11 in FIG. 1) is conducting. During the period $t_2$–$t_3$ the current $I_{COIL}$ through the primary winding of the ignition coil (13 in FIG. 1) is formed from self-induction current 18 and current of the power supply voltage 19, and has a total value shown at curve 20. At $t_3$ when the ignition coil switch (12 in FIG. 1) is turned OFF, the spark discharge reverses polarity to a positive polarity of its inductive discharge phase 22. The energy flowing through the diode 11 results in the slower drop in energy of the ignition coil 20 as compared to energy provided by a circuit absent the storage capacitor 18. This slower decay in energy of the ignition coil provides additional time for pre-charging of the circuit elements to support continuous discharge in the spark gap.

Referring again to FIG. 1, the methodologies of charging the storage capacitor 10 or transferring energy therefrom to the ignition coil 13 are based on operation of the storage coil 7 and storage capacitor 10. When the switch 8 is ON an amount of energy is accumulated in the storage coil 7. When the switch 8 is turned OFF and the switch 12 is OFF, energy accumulated in the storage coil 7 is transferred through the first diode 9 to the capacitor 10 charging it. If the switch 12 is ON when the switch 8 is switched OFF, the energy accumulated in the storage coil 7 is transferred directly to the ignition coil 13 producing high voltage in the secondary winding of the ignition coil 13 or additional current in the spark plug gap 14 when a capacitive discharge phase is in progress. Further it is possible to charge the capacitor several times by repeatedly charging the storage coil 7 and then discharging it to the capacitor 10 without discharging the capacitor through the ignition coil 13.

The above-described methodologies are combinable in a plurality of different combinations with different timing of control signals $S_1$ and $S_2$ to result in a highly customizable spark duration and profile.

This provides a simple, programmable, and extremely flexible spark generation circuit. Because of its simplicity, the circuit is not onerous to implement or to mass produce. Further, because of its flexibility it is optionally programmed to support a variety of engines or, more advantageously, to support different spark profiles depending on conditions of the engines and of the environments. For different engines and vehicles, for example, different spark profiles are used for different fuel injectors, for different fuel mixes, and for different engine geometries. For different conditions, for example, different spark profiles are used when the engine is cold than when it is warm. Different spark profiles are used depending on the RPM, the outside temperature, and so forth.

For example, to robustly initiate a spark having substantial power to support starting when the engine is particularly cold for example, one is able to discharge both charge storage elements simultaneously resulting in a spark having significant energy. To achieve this using the above-described circuit, a preparatory charge of the storage capacitor 10 is brought to a maximum voltage during a time when spark generation is other than occurring. The storage coil 7 is also charged by turning ON the switch 8 for a predetermined dwell time. When the spark is desired, for example at a timing mark, both switches are switched, the switch 8 OFF and the switch 120N. The energy stored in the capacitor and in the storage coil is simultaneously switched to flow through the ignition coil 13 initiating a powerful ignition spark.

Figure 3:
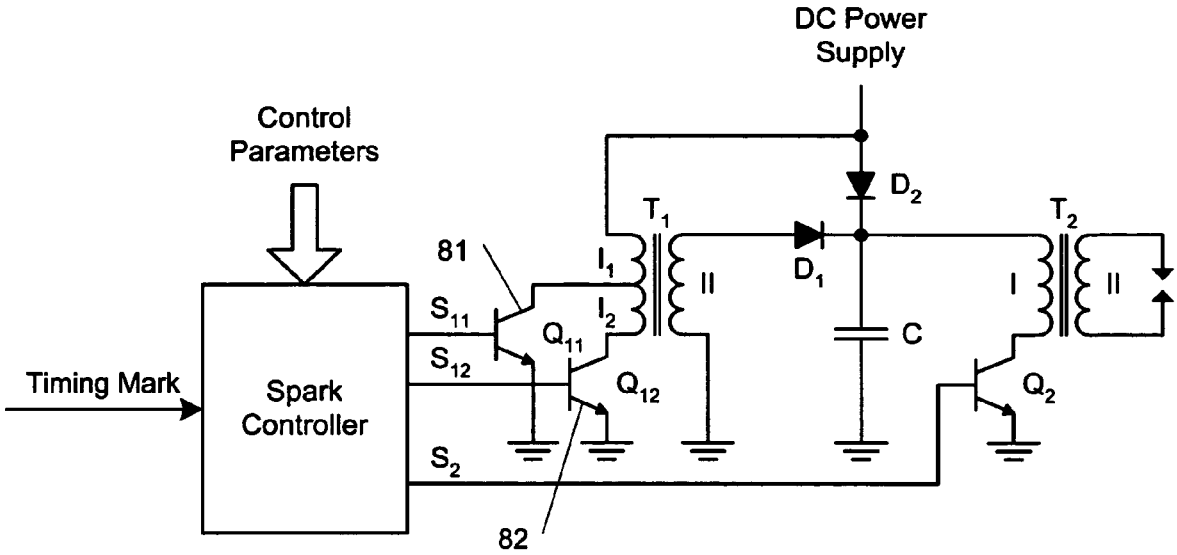
FIGS. 3–4 are simplified schematic diagrams of the circuit of FIG. 1 with additional switch to change winding ratio of the storage coil, and storage coil in the form of autotransformer.

Referring to FIG. 3, shown is a simplified circuit diagram of a circuit according to FIG. 1 but now having an intermediate junction in primary winding of storage coil connected to other switch 81 similar to switch 82. This allows using different winding ratio of storage coil and thus, different speed of energy release from the coil.

Figure 4:
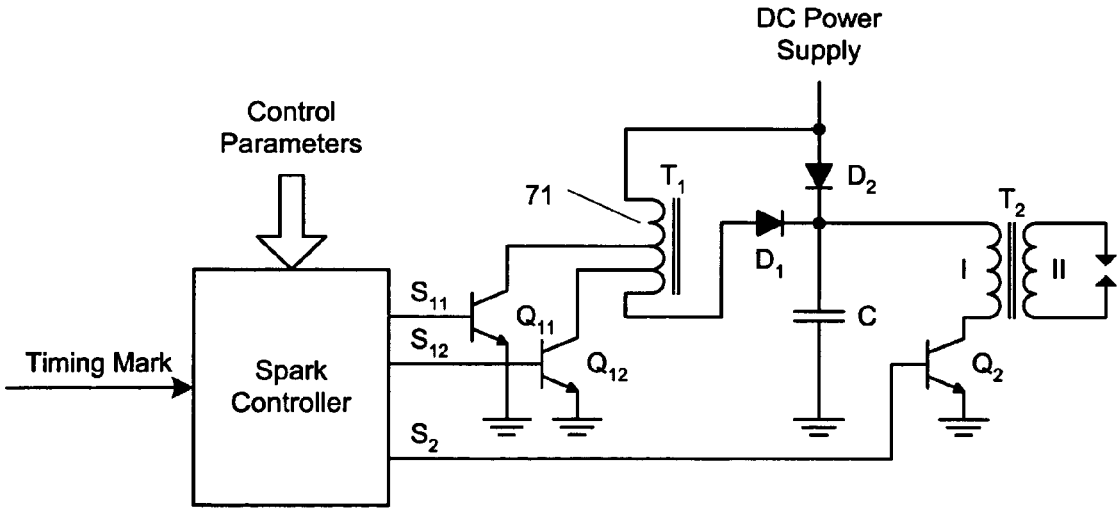

Referring to FIG. 4, shown is a simplified circuit diagram of a circuit according to FIG. 3 but now having the storage coil in the form of autotransformer 71. This allows simplifying the design of the storage coil.

Figure 5:
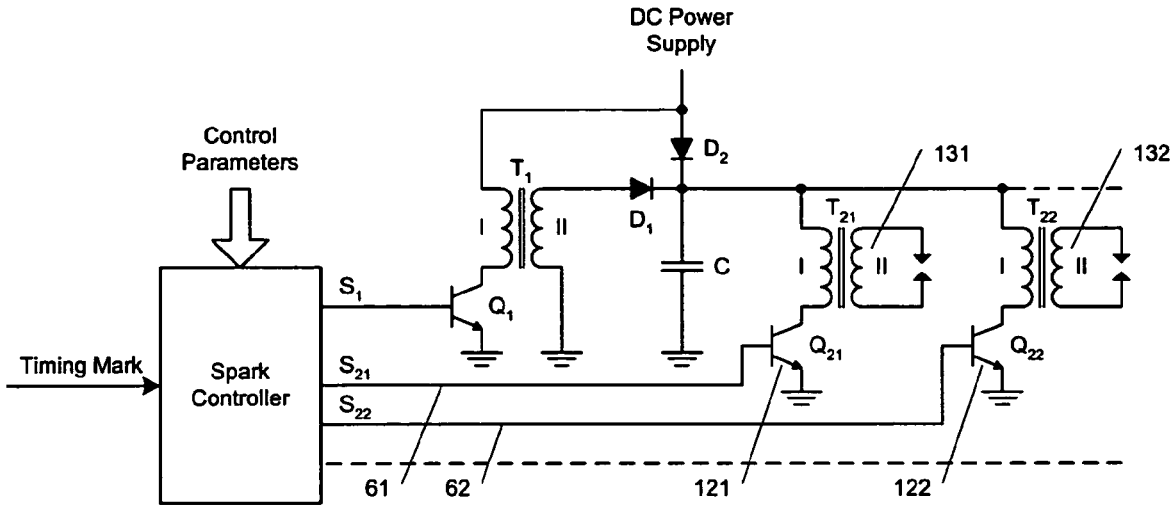
FIG. 5 is a simplified schematic diagram of the circuit of FIG. 1 coupled in a multi-channel fashion to a plurality of ignition coils and spark gaps.

Referring to FIG. 5, shown is a simplified circuit diagram of a circuit according to FIG. 1 but now including multi-channel operation. Here, where sparking of each cylinder of a multi-cylinder engine is performed in isolation, the circuit has a single energy storage portion and multiple energy discharge paths. Thus, each ignition coil, 131, 132, . . . are shown separately controlled by switch 121, 122, . . . , respectively. Each switch 121, . . . is controlled by a control signal provided along conductors 61, 62, . . . Thus, the circuit with little additional effort is applicable to multi-channel operation. Further, a same control circuit applies equally well to a multi-channel ignition system as to a single channel ignition system; typically, the only difference of the control process is multiplexing of the channels in working sequence of the cylinders. Of course, charge storage elements should be selected to store sufficient charge in sufficiently short period of time to support the multi-channel operation.

Figure 6:
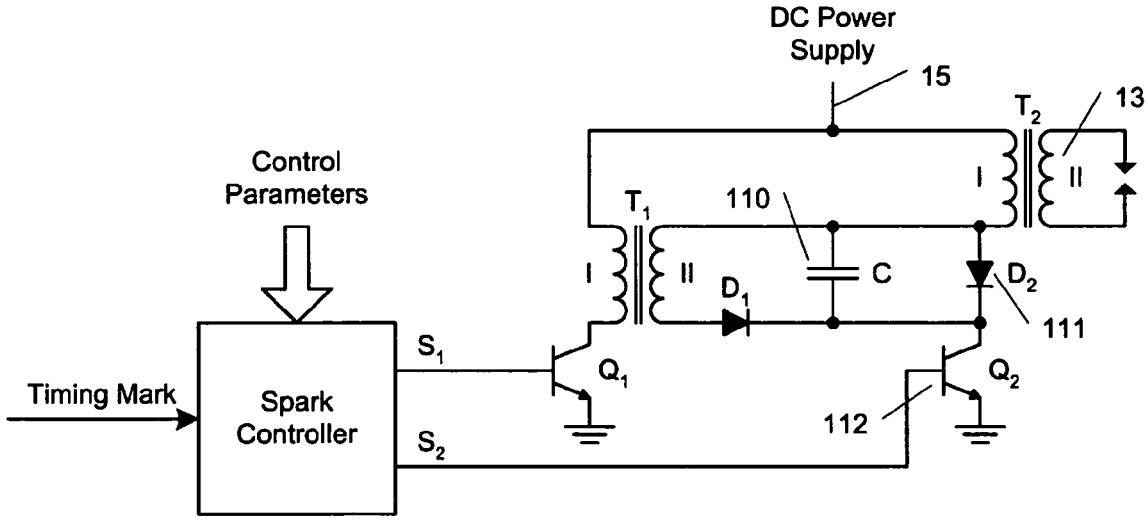
FIGS. 6–7 are schematic diagrams of a single channel embodiment suitable to being retrofit onto existing ignition control circuitry.

Referring to FIG. 6, shown is a schematic diagram of another embodiment of the invention suitable for retrofitting onto existing inductive discharge ignition circuits. The circuit is best suited to single channel operation as it would otherwise provide for more complexity in a multi-channel implementation than the circuit of FIG. 1. In FIG. 6, the ignition coil 13 is directly coupled to the DC power supply 15. The diode 111 and storage capacitor 110 are disposed in parallel with each other and in series between the ignition coil 13 and the switch 112.

Figure 7:
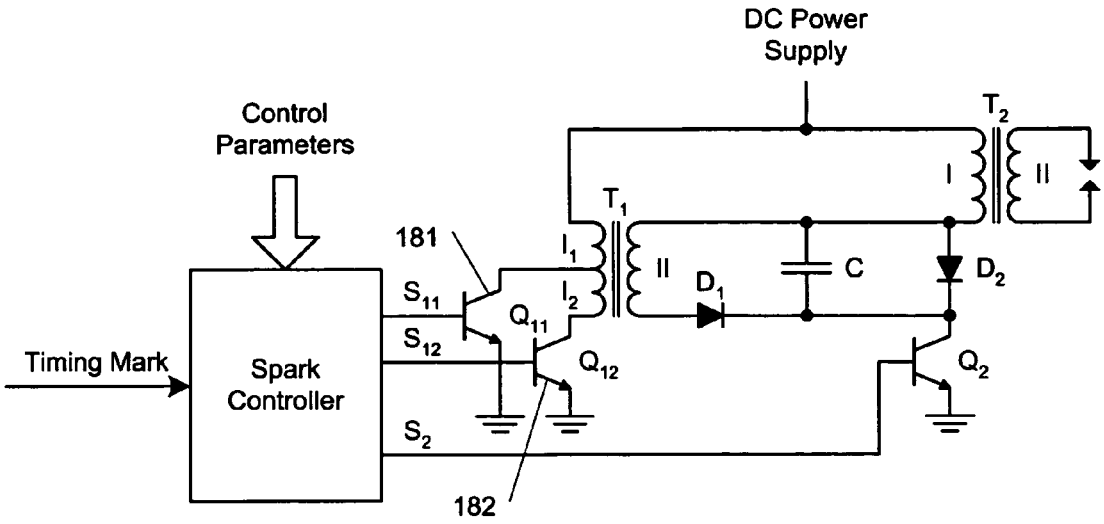

Referring to FIG. 7, shown is a simplified circuit diagram of a circuit according to FIG. 6 but now having an intermediate junction in primary winding of storage coil connected to other switch 181 similar to switch 182. This allows using different winding ratio of storage coil and thus, different speed of energy release from the coil.

The spark controller 1 is typically in the form of a microcontroller for providing timing signals based on instruction data stored thereon. This provides for a high degree of programmability allowing for reprogramming of the ignition system with changes to the engine that occur over time. Further, by reprogramming portions of the instruction data it is a simple matter to support different operation of an engine—e.g. cleaner operation, better performance, etc.

The above-described embodiments are implementable in a compact, inexpensive, and highly efficient fashion for conventional internal combustion engines. Careful implementation results in reduced fuel consumption and exhaust emissions over conventional ignition systems. Further, the above embodiments, in principal, are compatible with all types of spark ignition internal combustion engines.

Advantageously, the above embodiments are implementable supporting an active spark forming a continuous discharge as long as required by means of sequentially repeatable cycles of capacitive discharge and inductive discharge phases managed by the spark controller. These are characterized having a square bipolar form of voltage and in-phase current.

Further advantageously the above embodiments support two mechanisms for energy transfer to the ignition coil to initiate or assist the inductive discharge/capacitive discharge phase. The two mechanisms are useful both simultaneously and sequentially.

Also advantageously, the above described embodiments support controllable spark duration, distributed energy, and power profile of the spark discharge with two control signals based on frequency, duty cycle, interrelation, and running time. This is customizable depending on engine type, geometry, and operating conditions.

Figure 8:
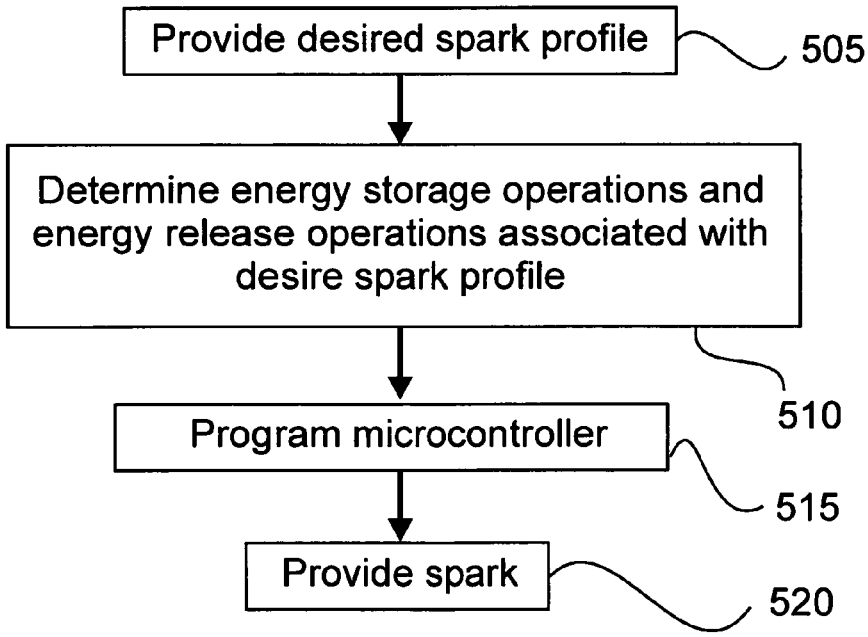
FIGS. 8–10 are simplified flow diagrams of embodiments of the invention.

Referring to FIG. 8, shown is a simplified flow diagram of a method of providing a spark with a predetermined profile. At 505, a desired spark profile is provided. At 510, a plurality of energy storage operations and a plurality of energy release operations are determined for effecting a spark profile similar to the predetermined profile. At 515, a microcontroller within the ignition circuit is programmed for effecting the plurality of energy storage operations and the plurality of energy release operations. Once executed at 520, the plurality of energy storage operations and the plurality of energy release operations are performed resulting in a spark of approximately the predetermined profile.

Figure 9:
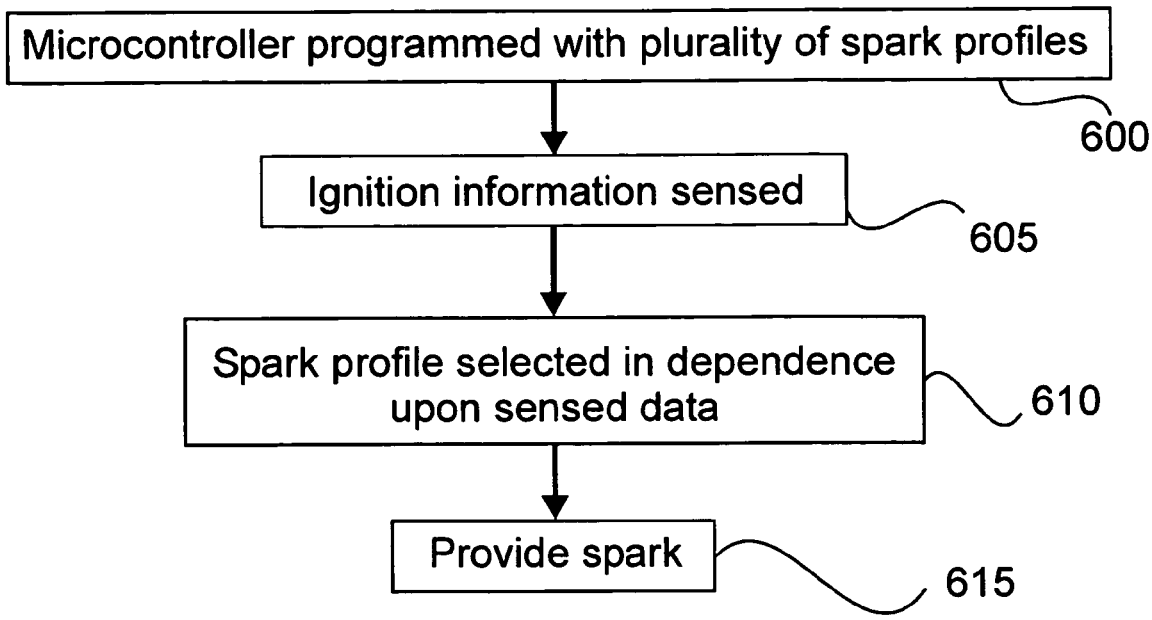

Referring to FIG. 9, shown is a simplified flow diagram of another embodiment. Here, a microcontroller is programmed with a plurality of different spark profiles at 600. At 605, a sensor senses information relating to the ignition circuit. Typically the information relates to operating conditions of the engine such as speed, temperature, efficiency, etc. At 610, the ignition circuit receives the sensed data and, in dependence thereon selects a spark profile from the plurality of different spark profiles. The spark is generated at 615 in a manner similar to that described with reference to FIG. 8.

Figure 10:
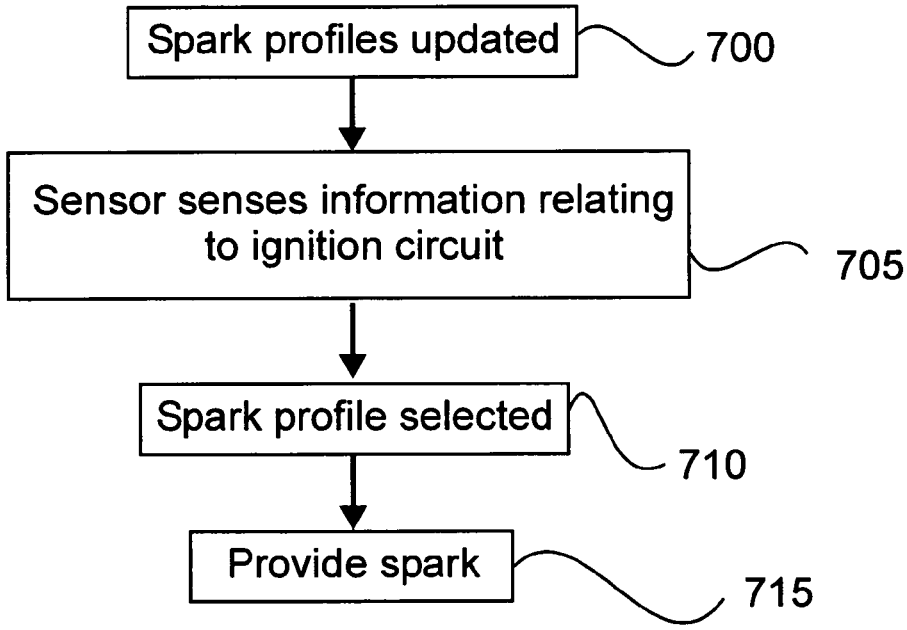

Referring to FIG. 10, shown is a simplified flow diagram of another embodiment. A plurality of different spark profiles is updated periodically at 700 in dependence upon an age and condition of the engine. At 705, a sensor senses information relating to the ignition circuit. Typically the information relates to operating conditions of the engine such as speed, temperature, efficiency, etc. At 710, the ignition circuit receives the sensed data and, in dependence thereon selects a spark profile from the plurality of different spark profiles. The spark is generated at 715 in a manner similar to that described with reference to FIG. 8.

Because of the increased time for the decay of energy from the ignition coil and careful selection of component values, it is possible to provide a circuit that supports sufficient decay time of the ignition coil energy to allow for charging of the energy storage coil to support continuous discharge across the gap. Further, depending on the energy in the storage coil and an interval between storage coil discharge to the ignition coil, different spark profiles result. As such, significant variability is supported even for continuous spark discharges.

The invention is applicable with appropriate design to many different applications. Though the above embodiments are described with reference to spark profile control, spark profile control is applicable to many different fields relying on combustion. For example, spark profile changes are useful for modifying emissions of a vehicle. For a carburetor-based vehicle the present invention is useful for significantly reducing HC and CO within exhaust emission during operation thereof. By supporting a more efficient combustion process harmful emissions are reduced.

Further, a spark profile for reducing the harmful emissions is dynamically configurable when a programmable spark generation circuit is relied upon. For vehicles that are older and/or have been improperly maintained deposits inside a combustion chamber and wear therein affect combustion and therefore affect emissions. This greatly affects a vehicles performance, for example in meeting emission control standards necessary in some jurisdictions. The above-described embodiments are useful in improving long term operation of combustion engines in several fashions. First, improved combustion efficiency reduces deposits within the combustion chamber. Second, even with existing deposits within the combustion chamber, the above-described embodiments, when programmable, aid in modifying the spark profile to improve engine efficiency. Thirdly, improved engine efficiency aids in cleaning of the chamber and is useful in restoring engine efficiency or improving of same. This is in contrast to existing engine cleaning technologies that rely upon chemicals, which are noxious and potentially damage an engine. Further engine cleaning procedures are expensive and are recommended for routine engine maintenance. Avoiding these is cost effective and advantageous.

Another advantage of the above-described embodiments is their suitability to alternative fuels and alternative fuel sources. Some fuel mixtures are very different from others. With the increased price of oil, there are many technologies promising other fuels and fuel mixtures for combustion engines. A sample, non-exhaustive list includes: compressed natural gas (CNG), liquefied petroleum gas (LPG), propane, ethanol (E10, E85, E95), biodiesel (B20, B100), hydrogen, and some of their compositions. Many of those have different combustion properties and mostly much lower ignitability compared to gasoline. For these varied fuel sources, ignition is a significant issue because many of those need more powerful or different sparks to ensure the combustion.

Similarly, different fuel mixtures are currently available. Consumers choose from a wide range of fuels, typically labelled ordinary or super or ethanol blend. Using the above-described programmable embodiments, it is possible to provide a series of standard spark profile, one for each fuel mix. Then, a consumer when they replenish their automobile with their choice in fuels, they also select the fuel type and a spark designed for that specific fuel type is programmed and generated during operation. This allows for selection of fuel and for benefit of the select fuel type.

As a specific example, lean mixtures enhance the efficiency of spark-ignited internal combustion engines and reduce exhaust emissions. A significant drawback to lean mixtures is limited firing, which is proportional to features of the igniter itself such as sparkplug and ignition driver. Advantageously, modifying a spark profile to improve combustion is an approach, different from fuel concentration for solving problems in a dynamic, modifiable, and tunable fashion. Lean burn combustion is a common target for high energy ignition system researchers.

For application to alternative science technologies wherein activation of fuel or physical treatments thereof are used to enhance engine performance. Here, due to the unknown and broad applications and areas of research, it is anticipated that programmability of the spark profile is beneficial as it ads to the modifiable and, therefore, experimental variables that are available for experimentation and modification. It is important to note that the physical structure of the engine and its intended performance are significant factors in achieving effective spark profile design and implementation.

Numerous other embodiments of the invention may be envisaged without departing from the spirit or scope of the invention.

What is claimed is:

1. An ignition system for providing energy across a spark gap comprising:

a first series closed circuit including a DC power supply, a primary winding of an energy storage coil and a first switching device;

the first circuit for supporting a charge of the energy storage coil when the first switching device is conducting, and a discharge of energy stored within the energy storage coil when the first switching device is nonconducting;

a second series closed circuit including a secondary winding of the energy storage coil, a first diode and an energy storage capacitor, the diode for preventing a flow of current from the energy storage capacitor to the secondary winding of the energy storage coil;

a third series closed circuit including the secondary winding of the energy storage coil, the first diode, a primary winding of an ignition coil and a second switching device;

the second and the third series closed circuits for supporting the discharge of energy stored within the energy storage coil via the first diode to the energy storage capacitor when the second switching device is nonconducting, and to the ignition coil when the second switching device is conducting;

a fourth series closed circuit including the energy storage capacitor, the primary winding of the ignition coil and the second switching device;

the fourth circuit for supporting the discharge of energy stored within the energy storage capacitor to the ignition coil when the second switching device is conducting;

a fifth series closed circuit including the DC power supply, a second diode, the primary winding of the ignition coil and the second switching device, the diode for providing a flow of current from the DC power supply to the primary winding of the ignition coil when the energy storage coil and the energy storage capacitor are discharged;

the fifth circuit for supporting a charge of the ignition coil when the second switching device is conducting, and a discharge of energy stored within the ignition coil when the second switching device is nonconducting; and, a control circuit for generating a first control signal and a second control signal, the first control signal for operating the first switching device, and the second control signal for operating the second switching device, wherein the components within the ignition system are chosen to support generation of a continuous spark across the spark gap.

2. An ignition system according to claim 1, wherein the energy storage coil has a winding ratio for providing predetermined peak current of the discharge of energy stored within the energy storage coil corresponding to an amount of stored energy.

3. An ignition system according to claim 2, wherein the primary winding of the energy storage coil has an intermediate junction electrically coupled to a switching device other than the first switching device to change the winding ratio upon an operating condition of the ignition system.

4. An ignition system according to claim 3, wherein the energy storage coil has a secondary winding electrically coupled to the primary winding and other than electrically coupled to ground in an autotransformer configuration.

5. An ignition system according to claim 1, wherein a coil device comprises the ignition coil and the second switching device and the coil device comprises a plurality of coil devices electrically coupled in parallel to the energy storage capacitor.

6. An ignition system according to claim 1 wherein the control circuit includes a first port for receiving a timing mark signal and a second port for receiving parameter data relating to operation of the control circuit, the first and second control signals for being generated in dependence upon the parameter data and the timing mark signal.

7. An ignition circuit according to claim 6 wherein the control circuit includes a third port for receiving sensor data relating to an operating condition of the engine, the first and second control signals for being generated in dependence upon the sensor data.

8. An ignition circuit according to claim 6 wherein the control circuit includes a third port for receiving sensor data relating to an operating condition of the engine, the first and second control signals for being generated in dependence upon the sensor data, the parameter data and the timing mark signal.

9. An ignition system according to claim 1 including memory for having instruction data stored therein, wherein the control circuit is programmable for producing a continuous spark, for producing each part of the continuous spark of predetermined amplitude, and for producing the continuous spark of predetermined duration and profile.

10. An ignition system according to claim 1 including memory for having instruction data stored therein, wherein the control circuit is programmable for producing a continuous spark.

11. An ignition system according to claim 1 including memory for having instruction data stored therein, wherein the control circuit is programmable for producing a continuous spark of predetermined duration and profile.

12. An ignition system according to claim 1 including memory for having instruction data stored therein, for when executed resulting in a continuous spark of predetermined duration and profile, the duration and profile longer than a spark from a single discharge of energy to a secondary winding of the ignition coil.

13. An ignition system for providing energy across a spark gap comprising:

a first series closed circuit including a DC power supply, a primary winding of an energy storage coil and a first switching device;

the first circuit for supporting a charge of the energy storage coil when the first switching device is conducting, and a discharge of energy stored within the energy storage coil when the first switching device is nonconducting;

a second series closed circuit including a secondary winding of the energy storage coil, a first diode and an energy storage capacitor, the diode for preventing a flow of current from the energy storage capacitor to the secondary winding of the energy storage coil;

a third series closed circuit including the DC power supply, a primary winding of an ignition coil, the secondary winding of the energy storage coil, the first diode and a second switching device;

the second and the third series closed circuits for supporting the discharge of energy stored within the energy storage coil via the first diode to the energy storage capacitor when the second switching device is nonconducting, and to the ignition coil when the second switching device is conducting;

a fourth series closed circuit including the DC power supply, the primary winding of the ignition coil, the energy storage capacitor and the second switching device;

the fourth circuit for supporting the discharge of energy stored within the energy storage capacitor to the ignition coil when the second switching device is conducting;

a fifth series closed circuit including the DC power supply, the primary winding of the ignition coil, a second diode and the second switching device, the diode for providing a flow of current from the primary winding of the ignition coil to the second switching device when the energy storage coil and the energy storage capacitor are discharged;

the fifth circuit for supporting a charge of the ignition coil when the second switching device is conducting, and a discharge of energy stored within the ignition coil when the second switching device is nonconducting;

a control circuit for generating a first control signal and a second control signal, the first control signal for operating the first switching device, and, the second control signal for operating the second switching device, wherein the components within the ignition system are chosen to support generation of a continuous spark across the spark gap.

14. An ignition system according to claim 13, wherein the energy storage coil has a winding ratio for providing predetermined peak current of the discharge of energy stored within the energy storage coil corresponding to an amount of stored energy.

15. An ignition system according to claim 14, wherein the primary winding of the energy storage coil has an intermediate junction electrically coupled to a switching device other than the first switching device to change the winding ratio upon an operating condition of the ignition system.

16. A method of ignition spark generation comprising:

providing an energy storage coil;

providing an energy storage capacitor;

providing an ignition coil;

storing energy within the energy storage coil;

storing energy within the energy storage capacitor;

storing energy within the ignition coil;

switching the energy stored within each of the energy storage coil and the energy storage capacitor to an ignition coil for generating a spark across a spark gap;

switching the energy stored within the energy storage coil to the ignition coil for generating the spark across the spark gap;

switching the energy stored within the energy storage capacitor to the ignition coil for generating the spark across the spark gap; and switching the energy stored within the ignition coil for generating the spark across the spark gap.

17. A method according to claim 16 comprising switching the energy stored within the energy storage coil and the energy storage capacitor to the ignition coil for generating the spark across the spark gap and simultaneously storing energy within the ignition coil.

18. A method according to claim 16 comprising switching the energy stored within the energy storage coil to the ignition coil for generating the spark across the spark gap and simultaneously storing energy within the ignition coil.

19. A method according to claim 16 comprising switching the energy stored within the energy storage capacitor to the ignition coil for generating the spark across the spark gap and simultaneously storing energy within the ignition coil.

20. A method according to claim 16, wherein switching the energy stored within the energy storage coil to the ignition coil for generating the spark across the spark gap and switching the energy stored within the ignition coil for generating the spark across the spark gap provide an energy discharge duration sufficient for recharging the energy storage coil for providing a continuous spark of duration limited only by a DC power source providing power to the circuit.

21. A method according to claim 20, wherein the energy storage coil is a coil of two windings with predetermined ratio, a first winding for providing a charge of the coil, and a second winding for providing a discharge of the coil.

22. A method according to claim 16 comprising providing a microcontroller for controlling of switching.

23. A method according to claim 16 comprising:

providing a program memory; and, storing instruction data within the program memory, different instruction data for resulting in different switching patterns.

24. A method according to claim 23, wherein different switching patterns result in sparks of different profile.

25. A method according to claim 23, wherein the program memory is programmable for producing a continuous spark, for producing each part of the continuous spark of predetermined amplitude, and for producing the continuous spark of predetermined duration and profile.

26. A method according to claim 23, wherein the program memory is programmable for producing a pattern of sparks having predetermined profile, duration, and timing, and wherein the profile, duration, and timing are each and all modifiable by modifying the instruction data stored within the program memory.

27. A method according to claim 16 comprising: providing sensor data relating to operating conditions of the engine, switching performed with timing based on the sensor data.

28. A method according to claim 16 comprising:

providing a desired spark profile;

determining based on the desired spark profile a plurality of energy storage operations and a plurality of energy release operations for resulting in a spark having approximately the desired spark profile; and controlling the switching to effect the plurality of energy storage operations and the plurality of energy release operations for resulting in a spark having approximately the desired profile.

29. A method according to claim 28, wherein the desired spark profile is other than a simple decaying current discharge.

30. A method according to claim 29, wherein the spark profile is other than a first decaying current discharge followed by a plurality of sequential overlapping identical decaying current discharges.

31. A method according to claim 28, wherein the spark profile is formed by a first decaying current discharge followed by a plurality of sequential overlapping decaying current discharges, some of the plurality of sequential overlapping discharges having different initial stored energy levels, different power profiles, and different durations.

32. A method according to claim 28, wherein the spark profile is formed by a first decaying current discharge followed by a plurality of sequential overlapping decaying current discharges, some of the plurality of sequential overlapping discharges having different initial stored energy levels.

33. A method according to claim 28, wherein the spark profile is formed by a first decaying current discharge followed by a plurality of sequential overlapping decaying current discharges, some of the plurality of sequential overlapping discharges having different power profile.

34. A method according to claim 28, wherein the spark profile is formed by a first decaying current discharge followed by a plurality of sequential overlapping decaying current discharges, some of the plurality of sequential overlapping discharges having different durations.

35. A method according to claim 28, wherein the spark profile comprises a continuous spark having a duration of approximately a duration of a combustion stroke of an engine.

36. A method according to claim 28, wherein the plurality of energy storage operations includes energy storage operations for storing different amounts of energy, the energy storage operations ordered in a monotonically decreasing fashion.

37. A method according to claim 28, wherein the plurality of energy storage operations includes energy storage operations for storing different amounts of energy, the energy storage operations ordered in a non-monotonically decreasing fashion.

38. A method according to claim 28, comprising:

sensing with a sensor information relating to the system to provide sensor data, wherein the switching is for effecting sparks of different profiles in response to the sensor data.

* * * * *